US005337125A

United States Patent [19]

Nakano et al.

[11] Patent Number: 5,337,125

[45] Date of Patent: Aug. 9, 1994

[54] TONER FEEDING DEVICE

[75] Inventors: Kuniaki Nakano, Nara; Kunio Nakai, Osaka; Masahiro Sako, Osaka; Shigeo Kurando, Osaka; Minoru Kishigami, Osaka; Masahiro Higashitani, Osaka; Yasuhiro Matsuo, Osaka; Toshinori Nishimura, Osaka; Tsugio Nakanishi, Osaka; Yasuyuki Hirai, Osaka; Shingo Mori, Nara, all of Japan

[73] Assignee: Mita Industrial Co., Ltd., Osaka, Japan

[21] Appl. No.: 890,622

[22] Filed: May 28, 1992

[30] Foreign Application Priority Data

May 29, 1991 [JP] Japan ..... 3-126040
May 29, 1991 [JP] Japan ..... 3-126041
Jun. 12, 1991 [JP] Japan ..... 3-168918

[51] Int. Cl.[5] ..... G03G 15/06
[52] U.S. Cl. ..... 355/260; 220/353
[58] Field of Search ..... 355/260, 245; 141/363, 141/365, 358, 367; 222/DIG. 1; 220/315, 353

[56] References Cited

U.S. PATENT DOCUMENTS 4,972,887 11/1990 Hacknauer et al. ..... 355/260 X
4,997,016 3/1991 Hacknauer et al. ..... 355/260 X
5,018,560 5/1991 Tsukamoto ..... 355/260 X
5,040,024 8/1991 Fukuda et al. ..... 355/260
5,040,025 8/1991 Funuchi ..... 355/260
5,074,344 12/1991 Vacek et al. ..... 141/363
5,091,750 2/1992 Yoshida et al. ..... 355/260
5,175,588 12/1992 Katagata ..... 355/260
5,207,353 5/1993 Corby et al. ..... 355/260 X
5,235,390 8/1993 Ishikawa ..... 355/260

*Primary Examiner*—Leo P. Picard
*Assistant Examiner*—Christopher Horgan
*Attorney, Agent, or Firm*—Koda and Androlia

[57] ABSTRACT

It is a major object of the present invention to break down and level a heap-up of toner built in the hopper through dropping from the cartridge when feeding toner into the hopper and to prevent toner from leakage from the cartridge due to erroneous operation with a remarkably simple and cheap construction. Namely, the leveling member moves a plurality of number of times in line with engaging and disengaging operation of the cartridge for the hopper and opening and closing operation of the cartridge in the same direction of the shutter, thereby causing a heap-up of toner built in the hopper housing of the hopper to be effectively broken down and leveled. Furthermore, only when the shutter is in its closed status for the cartridge, the cartridge can be removed from the opening of the hopper.

21 Claims, 18 Drawing Sheets

TONER FEEDING DEVICE

BACKGROUND OF THE INVENTION

1. Field of the invention

This invention relates to a toner feeding device for feeding toner to a toner hopper of a developing unit provided in an image forming apparatus such as a copying machine, etc.

2. Description of the Prior Art

Conventionally, such a device as disclosed by, for example, a Japanese Patent Laid Open No. SH0-59-34564 has been publicly known as this kind of toner feeding device.

In the device disclosed by the above official gazette of a Japanese patent, a cartridge which accommodates toner is removably installed at an opening provided at the upper part of the hopper. And the toner accommodated in the cartridge is fed to the hopper through a feeding port installed at the lower part of the cartridge and an accommodating port installed at the opening of the hopper. Furthermore, at this time, a leveling member projected downwards from the opening of the hopper is moved in the same direction as the movemental direction of a shutter in line with opening movements of the shutter installed at the feeding port of the cartridge, and the toner fed into the hopper is leveled by the leveling member.

After toner is fed into the hopper as shown above, the cartridge is then removed from the upper part of the hopper.

Furthermore, such technologies as disclosed by, for example, Japanese Patent Official Gazettes No. SH0-59-36268, SH0-59-36270 or SH0-62-978 have been proposed at the standpoint of view in which toner may not leak outsides in line with a series of toner feeding work described above.

In these technologies, such arrangements as the cartridge is locked in movement linked with mounting action of cartridge for the hopper or an opening/closing cover installed at the cartridge and the hopper have been provided, thereby causing leakage of toner due to erroneous operation to be prevented.

Actually however, in a conventional toner feeding device so composed of a leveling member as shown above, there is a shortcoming due to which sufficient leveling effect can not be obtained, because the leveling member moves almost in line with the shutter only when opening the shutter, and heap-up of toner which is made in the hopper through dropping from the cartridge is broken down and leveled by the leveling member.

Especially, it is remarkable, for example, in the case that a lump of a heap of toner drops toward the hopper from the cartridge with some delay of time after the shutter is opened and the leveling member finishes its action.

In the technologies disclosed by each of the above official gazettes which have been proposed for the purpose of preventing leakage of toner toward outside on the occasion of a series of toner feeding work, a lock mechanism and an interlock mechanism are to be installed, respectively, and the construction thereof will be complicated and complex, along with a problem that the production cost thereof will become high.

SUMMARY OF THE INVENTION

It is therefore the first object of the present invention to provide a toner feeding device which can provide a function to level a heap-up of toner built in the hopper through effectively breaking down by actuating such a leveling member as described above a plurality of number of times.

Furthermore, it is the second object of the present invention to provide a cartridge which can be preferably applicable to such a toner feeding device as described above.

Still furthermore, it is the third object of the present invention to provide a toner feeding device which is constructed at a remarkably low cost and with a simple structure and which can prevent toner from leakage due to erroneous operation.

In order to achieve the first object, in a toner feeding device in which a cartridge accommodating toner is removably installed at an opening provided at the upper part of the hopper, and the toner accommodated in the cartridge is fed to the hopper through a feeding port provided at the lower part of the cartridge and an accommodating port provided at the opening of the hopper and at the same time the toner accommodated in the hopper is leveled by actuating a leveling member projected downwards from the opening thereof, major means employed in the present invention comprises, in the gist thereof, opening/closing means which is slidably installed at the lower part of the cartridge and can open and close the feeding port, and guide means which is installed at the opening of the hopper and slidingly guides the cartridge in parallelism with the opening and closing direction of the opening/closing means from the engaging and disengaging position of the cartridge to the mounted position thereof where the feeding port is confronted to the accommodating port, and is characterized in that the leveling member is shiftably supported in parallelism with the opening and closing direction of the opening/closing means and at the same time the above opening/closing means removably engaged with the leveling member at the engaging and disengaging position of the cartridge, and the leveling member is actuated in line with the engaging and disengaging operation of the cartridge for the opening and the opening and closing operation of the opening/closing means.

In a toner feeding device according to the above construction, as the leveling member is actuated a plurality of number of times in line with the engaging and disengaging operation of the cartridge for an opening of hopper and the opening and closing operation of the opening/closing means when feeding toner, a heap-up of toner which is made in the hopper can be effectively broken and is leveled almost uniformly.

And in order to achieve the second object, in a toner cartridge which, in connection with for a hopper having a leveling member for leveling toner and a locking mechanism and provided with an opening/closing cover for shutting a toner accommodating port, can be mounted only when feeding toner and removed after toner feeding is finished, major means employed by the present invention is, at the gist thereof, placed in that a body which accommodates toner is provided with opening/closing means for opening and closing the toner feeding port, and at the same time the opening/closing means is provided with the first projection for releasing the locked status in engagement with the locking mechanism when the body is mounted in the hopper and the second projection which enables leveling actions in engagement with the leveling member.

In the toner cartridge according to the above construction, as the above first projection comes in engagement with the locking mechanism when the body is mounted in the hopper, and allows the locked status thereof to be released, and at the same time the above second projection comes in engagement with the leveling member thereby causing the leveling action thereof to be permitted, opening of the opening/closing member and leveling action of the leveling member can be easily simply carried out.

Furthermore, in order to achieve the above third object, in a toner feeding device in which a cartridge accommodating toner is removably installed at an opening provided at the upper part of the hopper, and the toner accommodated in the cartridge is fed to the hopper through a feeding port provided at the lower part of the cartridge and an accommodating port provided at the opening of the hopper, major means employed by the present invention comprises; in the gist thereof, opening/closing means which is slidably installed at the lower part of the cartridge and opens and closes the feeding port; guide means which is installed at the opening of the hopper, allows the cartridge to be engaged and disengaged with the opening/closing means only when the opening/closing means is in its closed status for the cartridge, and slidingly guides the cartridge in parallelism with the opening and closing direction of the opening/closing means, under such a condition that the cartridge can not be disengaged from the hopper, from the engaging and disengaging position of the cartridge to the mounted position thereof where the feeding port is confronted to the accommodating port, regulating means which is installed at the opening of the hopper and which regulates movements of the opening/closing means exceeding the area corresponding to the accommodating port of the hopper of the opening/closing means under such a state that the cartridge is engaged with the guide means;

In a toner feeding device according to the above construction, the cartridge can be mounted on the hopper and removed therefrom only when the opening/closing means is in its opened status for the cartridge. Also, as the opening/closing means of cartridge is relatively closed by action of the regulating means even though it is erroneously tried that the cartridge is operated during feeding of toner, the feeding port of the cartridge is in its closed status by the opening/closing means when such a state that the cartridge can be removed from the hopper is made. As described above, it is possible to prevent toner from leakage due to erroneous operation with a remarkably simple and cheap construction.

DETAILED DESCRIPTION OF THE PREFERRED EMBODIMENTS

The preferred embodiments of the present invention are described with reference to the attached drawings for understanding the present invention. Furthermore, the following preferred embodiments are examples of embodiment of the present invention and do not intend to limit the technological scope of the present invention.

A toner feeding device according to the preferred embodiment is constituted so that, as shown in FIG. 1 through FIG. 8, it consists of a hopper 3 of a developing unit 2 arranged in vicinity of the surface of a photosensitive drum 1 and a cartridge (shown in FIG. 5) 4 which accommodates toner and is removably mounted on the upper part of the hopper 3.

Figure 2:
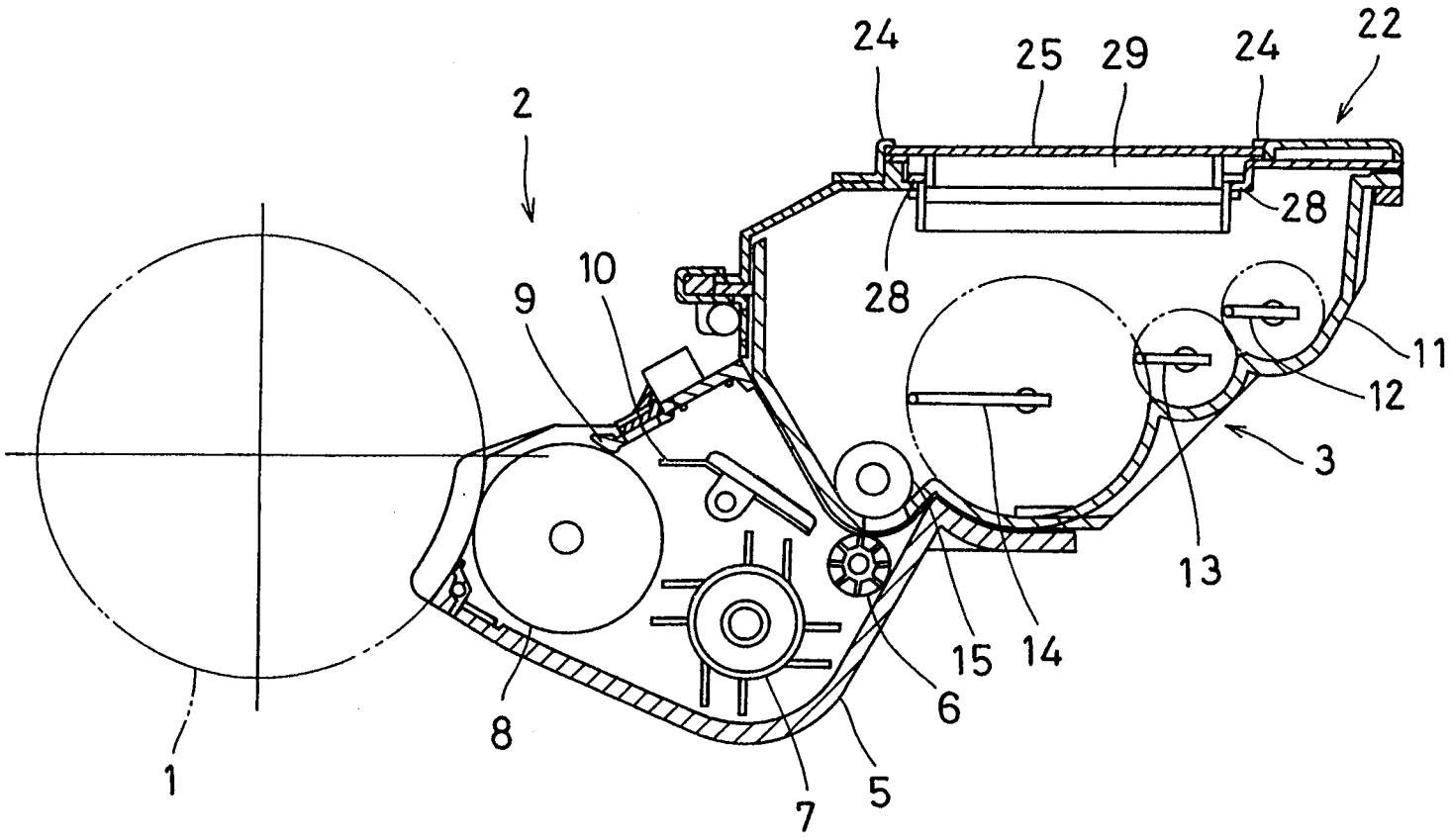
FIG. 2 is a front sectional view of FIG. 1.
Figure 3:
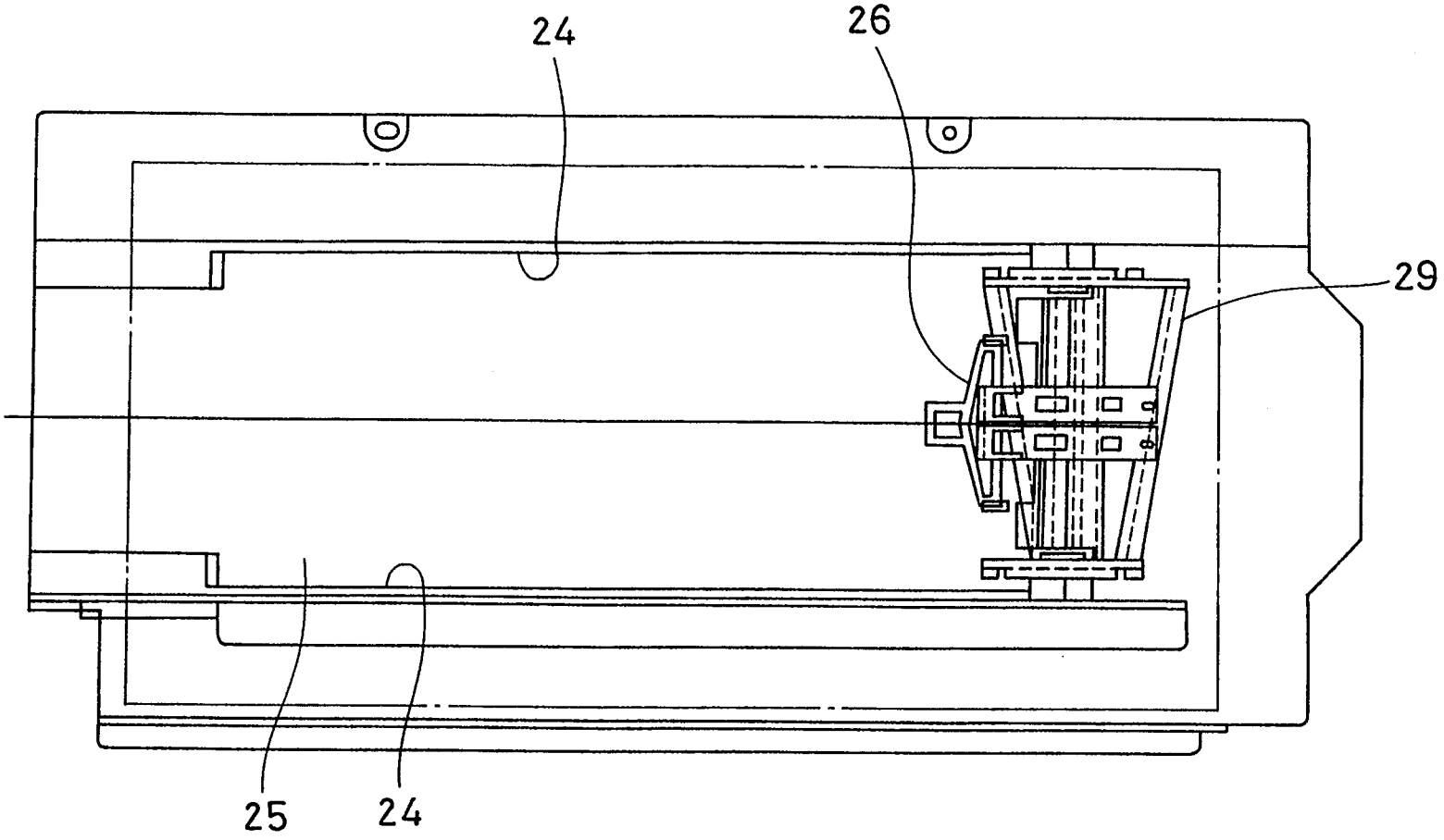
FIG. 3 is a plan view showing major parts of FIG. 1.

The developing unit 2, as shown in FIG. 2., has a mixer roller 6, an agitating paddle 7, a developing sleeve 8, a true-up plate and a partition plate 10, etc., inside the developing housing 5 thereof, and a hopper housing 11 which constitutes the hopper 3 is arranged in parallel at the upper part of the developing housing 5.

A plurality of toner feeding members 12, 13, 14 and a toner feeding roller 15, etc., are arranged inside the hopper housing 11.

Figure 5:
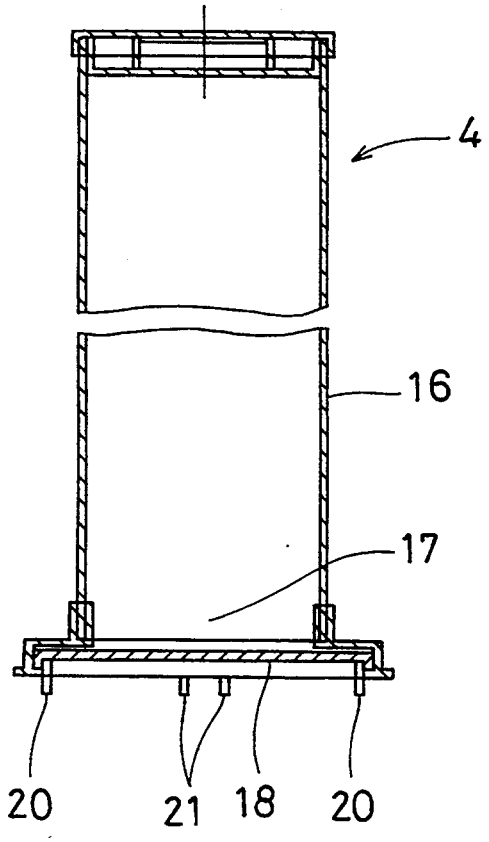
FIG. 5 is a front sectional view of a cartridge which constitutes the above toner feeding device.
Figure 6:
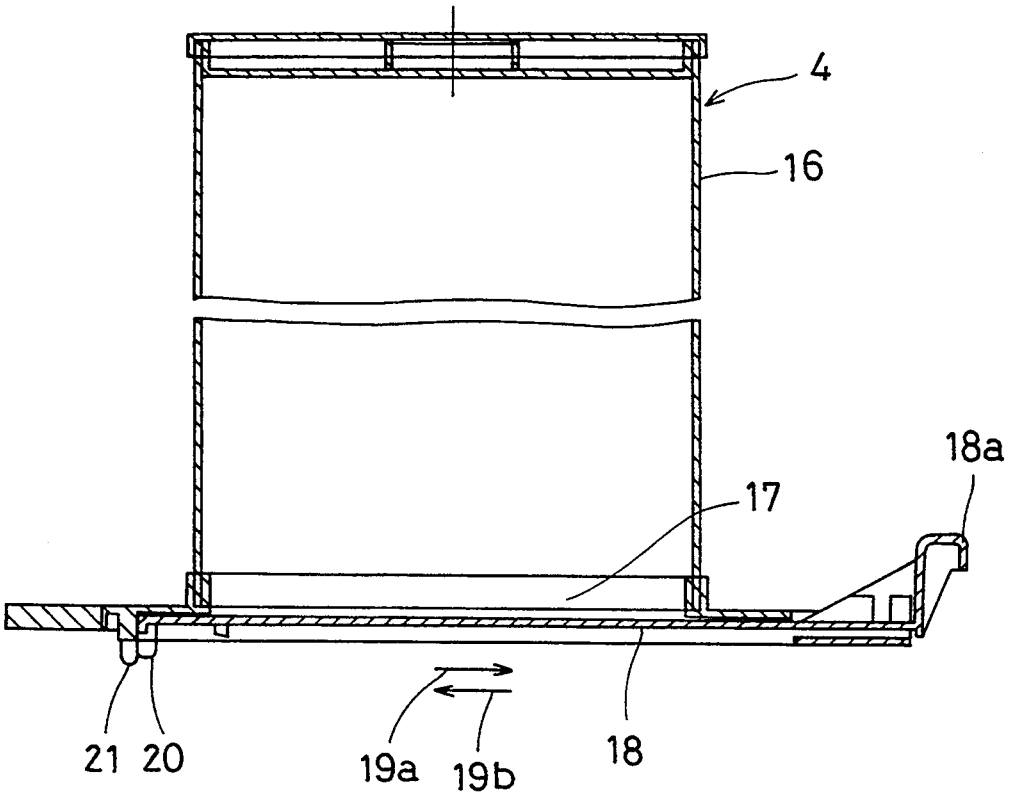
FIG. 6 is a side sectional view of the above cartridge.

As shown in FIG. 5 and FIG. 6, a shutter 18 which opens and closes the toner feeding port 17 opened to the lower part of the cartridge body 16 is provided with a grip 18*a* and is arranged slidably in the direction of arrows 19*a* and 19*b*. A set of projections 20,20 is provided downwards at both the sides of the extreme closing side edge of the shutter 18. The projection 20 comes in engagement with a leveling member described later and is used for mounting and removing operation of the cartridge 4 for the hopper 3 and actuation of the leveling member in line with opening and closing operations of the shutter 18.

A set of projections 21,21 are provided downwards at a position adjacent to the feeding port 17 at the underside of the cartridge body 16. The projection 21 releases the locking of the opening/closing cover described later of the hopper 3 and makes action to open the opening/closing cover in line with the mounting movements of the cartridge 4.

Figure 4:
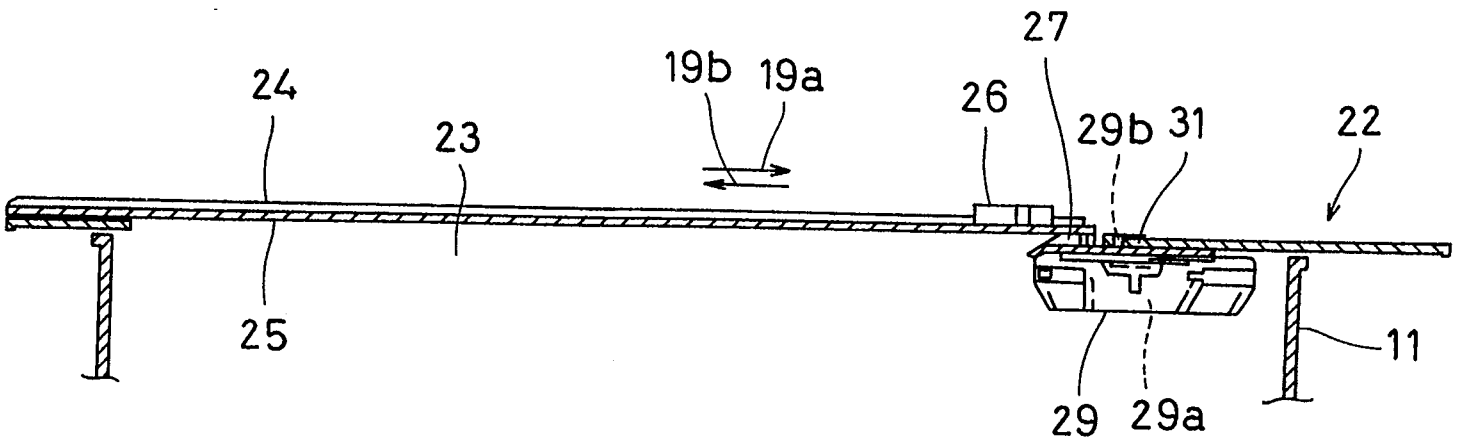
FIG. 4 is a side sectional view of FIG. 3.

As shown in FIG. 4, an opening 22 is formed at the upper part of the hopper housing 11 in the hopper 3, and an accommodating port 23 to accommodate toner in the cartridge 4 is established at the opening 22.

Figure 15:
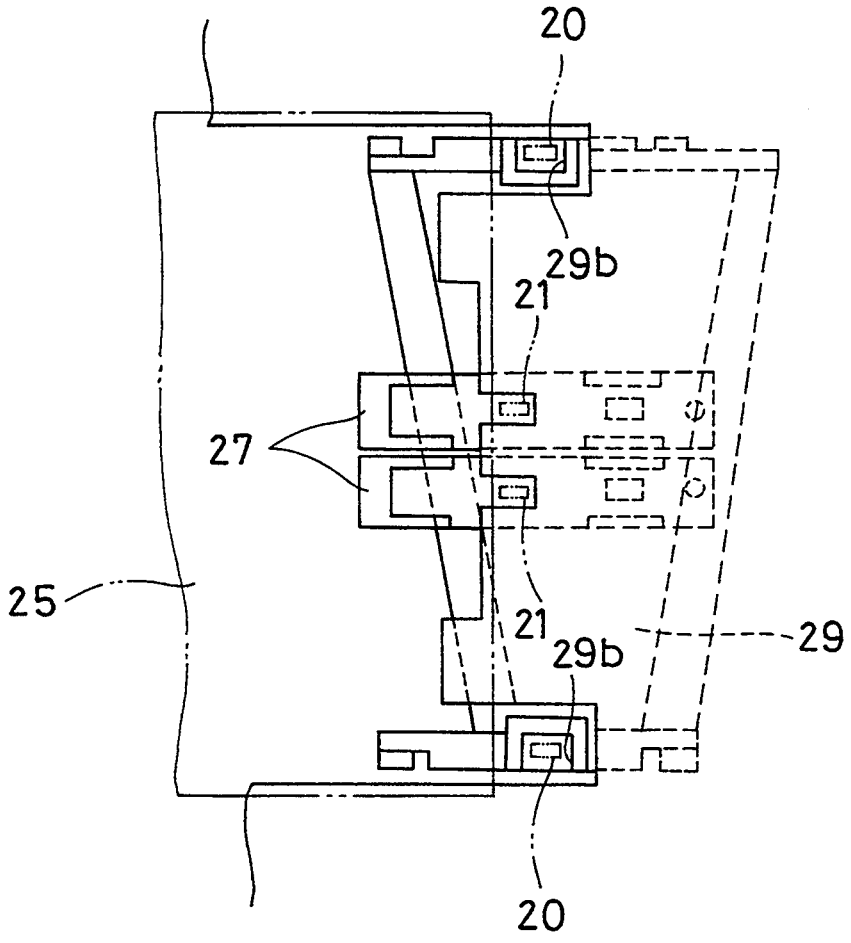
FIG. 15 is a plan view of parts shown with an arrow G in FIG. 10.
Figure 16:
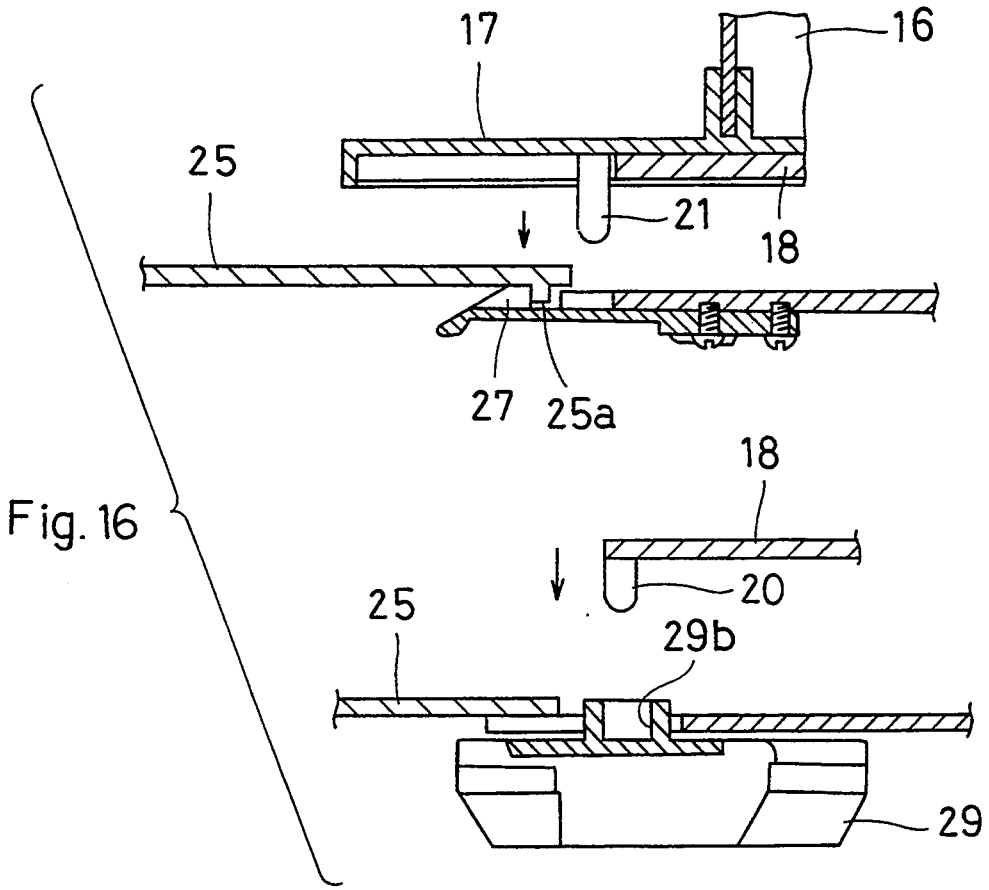
FIG. 16 is an explanatory view showing the disassembled status of the construction shown with an arrow H in FIG. 10.

At both the sides in the lengthwise direction of the opening 22, a set of as shown in FIG. 4, which are formed to be roughly L-shaped as observed in the section thereof, are disposed so as to be faced to each other, and the opening/closing cover 25 which opens and close the accommodating port 23 is fitted and placed in the rails 24, 24 slidably in the direction of arrows **19*a* and 19*b*. A positioning projection 26 to mount the cartridge 4 in the hopper 3 is formed at one edge side of the upper face of the opening/closing cover 25, and the opening/closing cover 25 is stopped and fixed by means of a set of hooks 27, 27 at the extreme closing edge side of the accommodating port 23 when it is closed. The hooks 27, 27 are formed of, for example, plate spring member, and are elastically transposable in the up and down direction thereof. As the hooks 27, 27 are pushed in downwards by the projections 21, 21 as shown in FIG. 5, FIG. 6 and FIG. 15 of the cartridge 4 when mounting the cartridge 4 in the opening 22, engagement between the hooks 27, 27 and the engaged portion 25*a* as shown in FIG. 16 at the end of the opening/closing cover 25 is cancelled, and the opening/closing cover 25 becomes shiftable in the direction of an arrow 19*b*. Under this condition, as the opening/closing cover 25 is pushed in the direction of an arrow 19*b* by the projections 21, 21, the opening/closing cover 25** is released.

The above rails 24, 24 are opened in correspondence to the engaging and disengaging position of the cartridge so that only when the shutter 18 is in its closed status for the cartridge 4 the projections 20, 21 are made to advance toward the side of hopper 3, thereby causing the cartridge 4 to be engaged and disengaged (Refer to FIG. 1), and the rails 24, 24 make action of sliding and guiding the cartridge 4, in parallelism with the opening and closing direction of the shutter 18 (direction of arrows **19*a* and 19*b*), under a state unreleasable from the opening 22 of the hopper 3 from the engaging and disengaging position of the cartridge 4 toward the mounted position where the feeding port 17 of the cartridge 4 is confronted to the accommodating port 23 of the hopper 3**.

Figure 7:
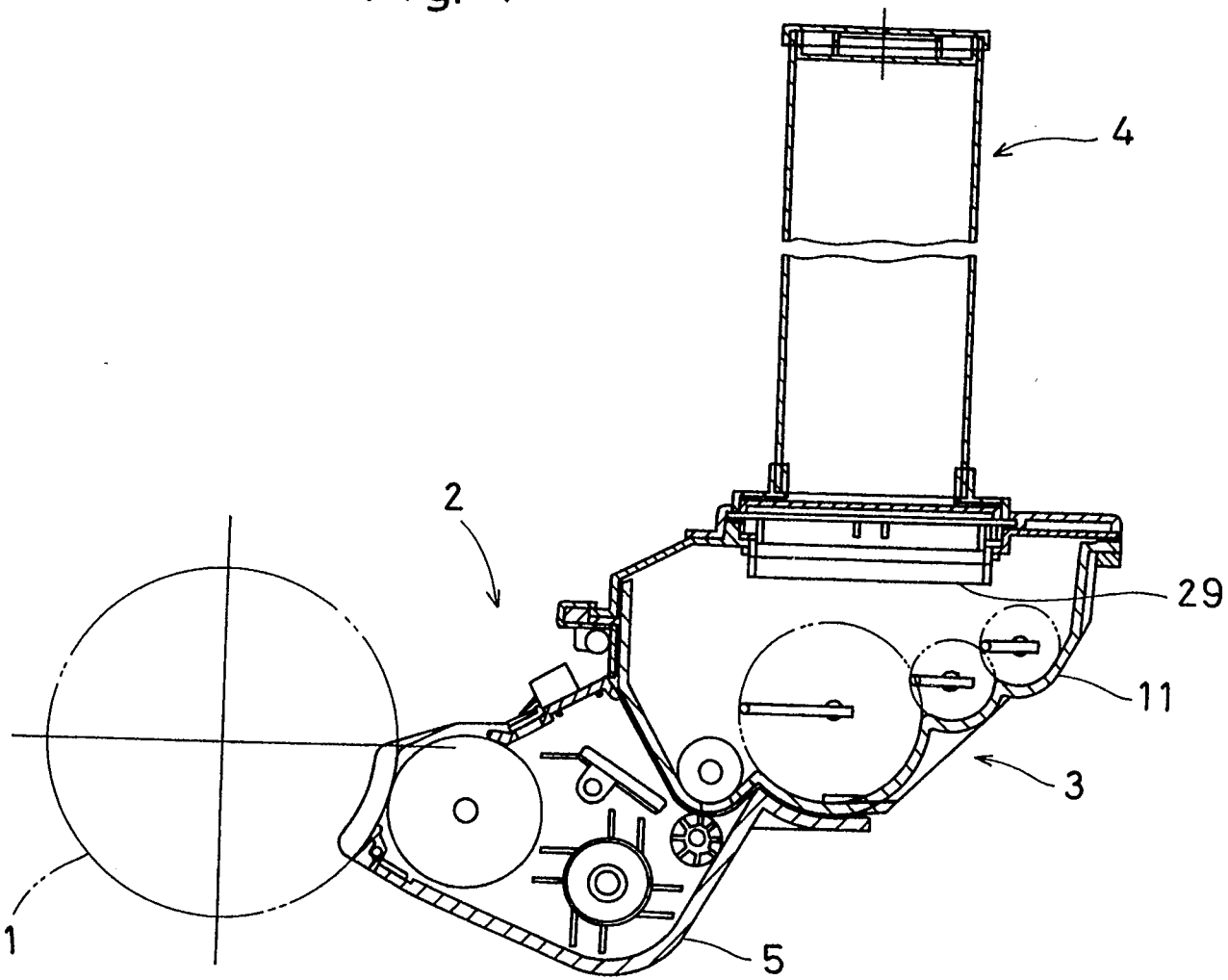
FIG. 7 is a view equivalent to FIG. 2, with the cartridge mounted to the hopper.
Figure 8:
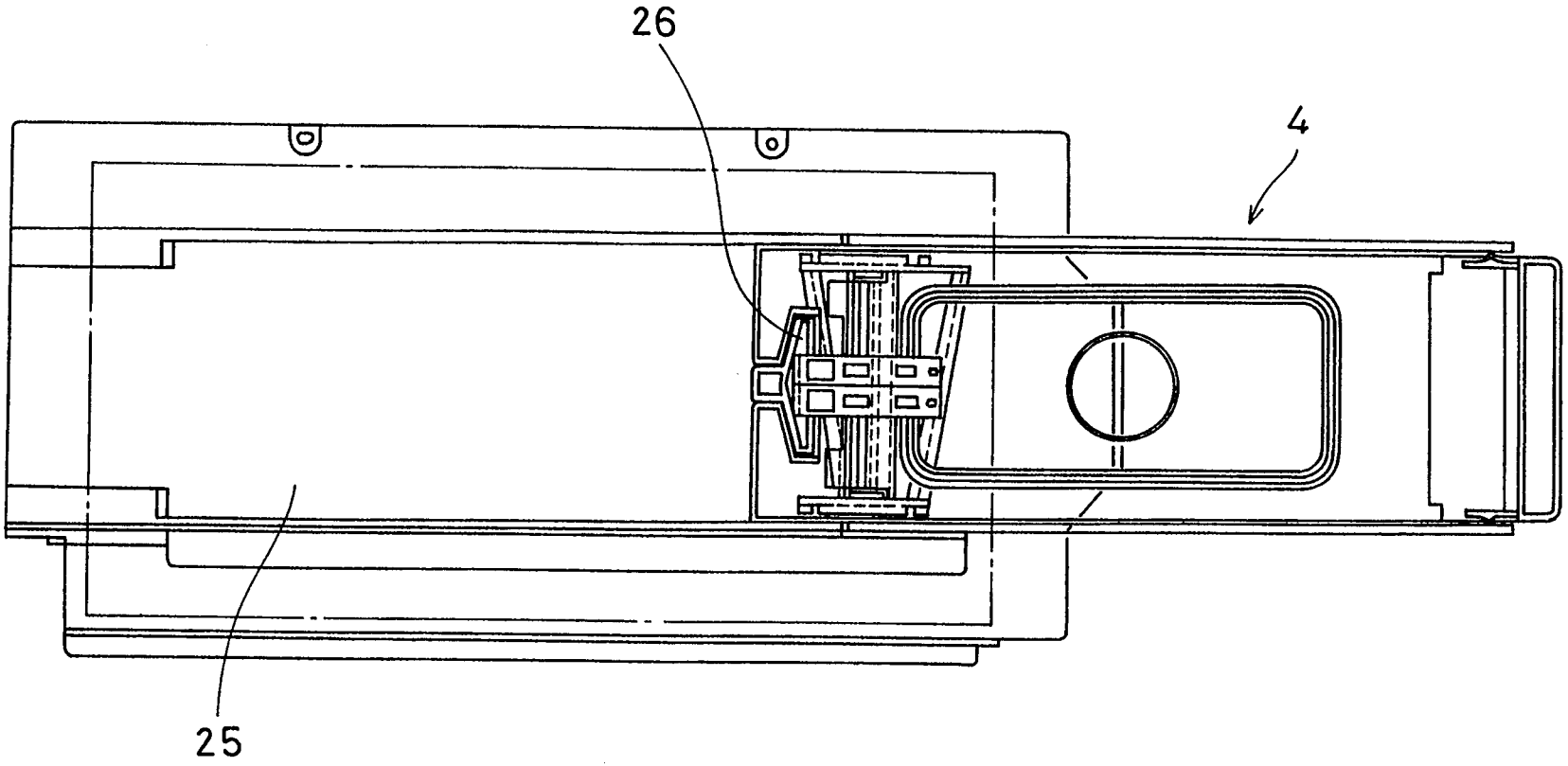
FIG. 8 is a plan view showing major parts of FIG. 7.
Figure 9B:
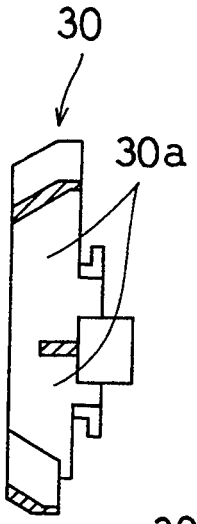
FIG. 9B is a cross sectional view taken along the line E—E′ in FIG. 9A.
Figure 9A:
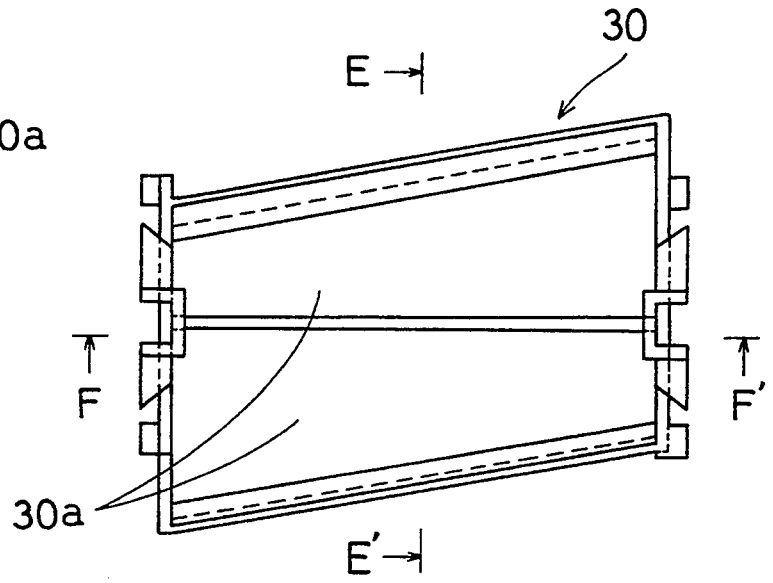
FIG. 9A is a view showing a leveling member according to another preferred embodiment, which is applicable to the hopper.
Figure 9C:
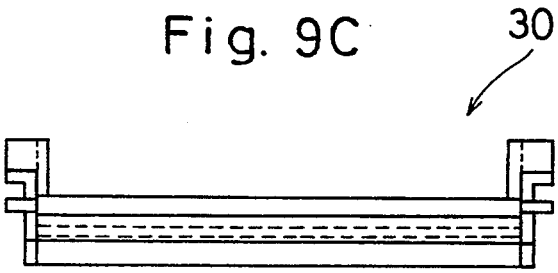
FIG. 9C is a front elevation view of FIG. 9A.
Figure 9D:
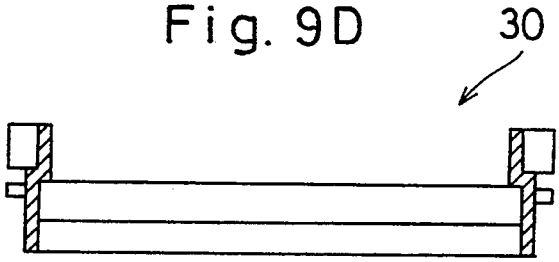
FIG. 9D is a cross sectional view taken along the line F—F′ in FIG. 9A.

A set of rails 28, 28 are provided and extend in parallelism with the rails 24, 24 underside the rails 24 as shown in FIG. 2, 24. And the leveling member 29 is slidably fitted to the rails 28, 28 as shown in FIG. 7. The leveling member 29 is provided as shown in FIG. 2 downwards from the opening 22, and a heap-up of toner which drops from the cartridge 4 and is formed in the hopper 3 makes action of breaking down and leveling thereof. The leveling member 29 is provided with an opening **29*a* for passage of toner at the central part thereof. Furthermore, both the sides of the leveling member 29 roughly at right angle direction in relation to the direction of movement thereof are inclined and formed so that the right side portion thereof in the moving direction can come behind the left side portion thereof. Namely, they are formed so that toner can be efficiently led to the side of the toner feeding roller 15. Accordingly, it is possible to level toner in the hopper 3 more uniformly and furthermore to prepare toner in advance in the surrounding of the toner feeding roller 15**.

Figure 10:
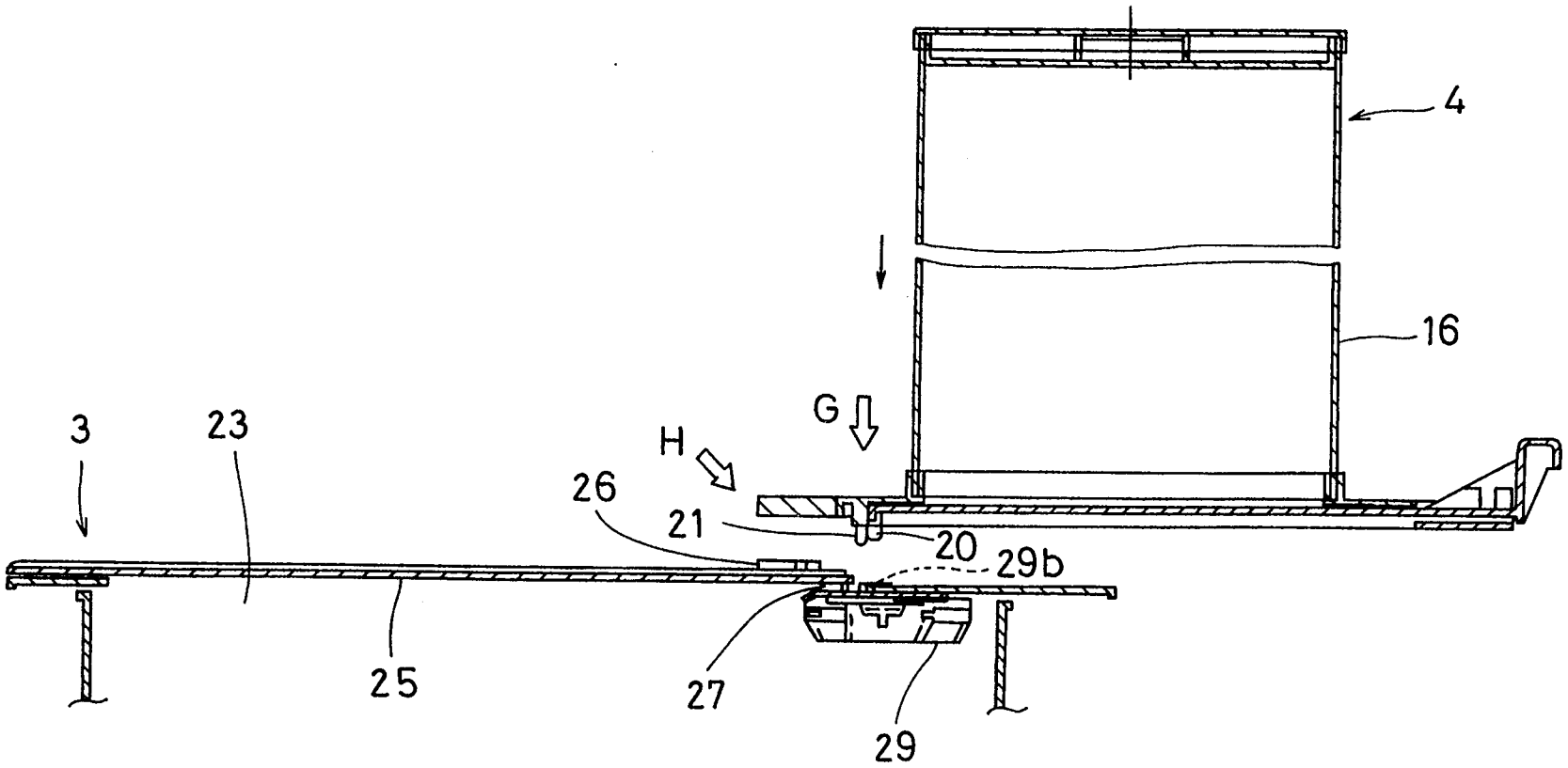
FIG. 10 is an explanatory view showing the operating procedures on mounting the cartridge on and removing it from the hopper.

Furthermore, the leveling member 29 can move in engagement with the projection 20 installed at the cartridge 4 as described above. But, engaging holes **29*b*, 29*b* for engagement with the projection 20 of the leveling member 29 are arranged so that the upper thereof can be opened at the distance position from the ends of the rails 24, 24 so as for the leveling member 29 and the projection 20 to be disengageably engaged only when the cartridge 4 is located at the engaging and disengaging position thereof (Refer to FIG. 1 and FIG. 10**).

Furthermore, in this case, it is possible to use a leveling member 30 shown in FIG. 9A through FIG. 9D instead of the leveling member 29 described above, too.

As shown in the same Figures, the leveling member 30 has an opening **30*a* for passage of toner at the central part thereof, and regarding the direction of movement thereof, both the sides thereof roughly in the right angle direction are inclined to be formed at a specified angle so as to be parallel with each other as observed on the plan view. Therefore, when breaking down a heap-up of toner by using the leveling member 30**, the pushing and flowing direction of toner is reversed in the go movement and return movement thereof, thereby causing leveling of toner to be made more effective.

Furthermore, a regulating unit 31 for regulating the scope of movement of the leveling member 29 in engagement with a part of the leveling member 29 is provided at the opening 22 of the hopper 3. The regulating unit 31 makes action of regulating, via the leveling member 29, so that the cartridge 4 can not move beyond the area where the shutter 18 corresponds to the accommodating port 23 of the hopper 3, under such a state that the cartridge 4 is engaged with the rails 24, 24.

The toner feeding device according to the present invention is so composed as shown above.

Subsequently, the mounting and removing procedure of the cartridge 4 for the hopper 3 is described with reference to FIG. 10 through FIG. 17.

Figure 1:
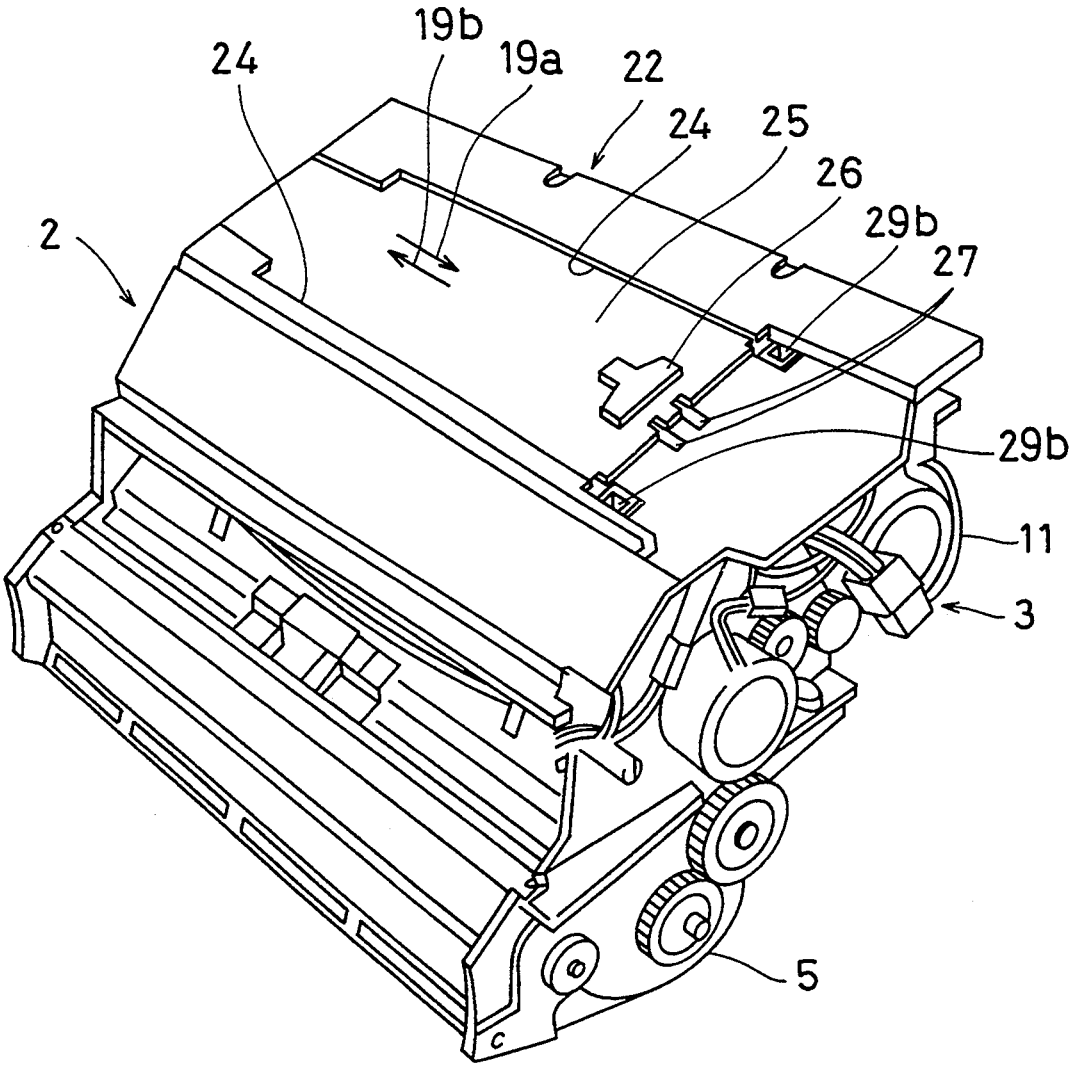
FIG. 1 is a perspective view showing the appearance of a hopper which constitutes a toner feeding device according to a preferred embodiment of the present invention.
Figure 11:
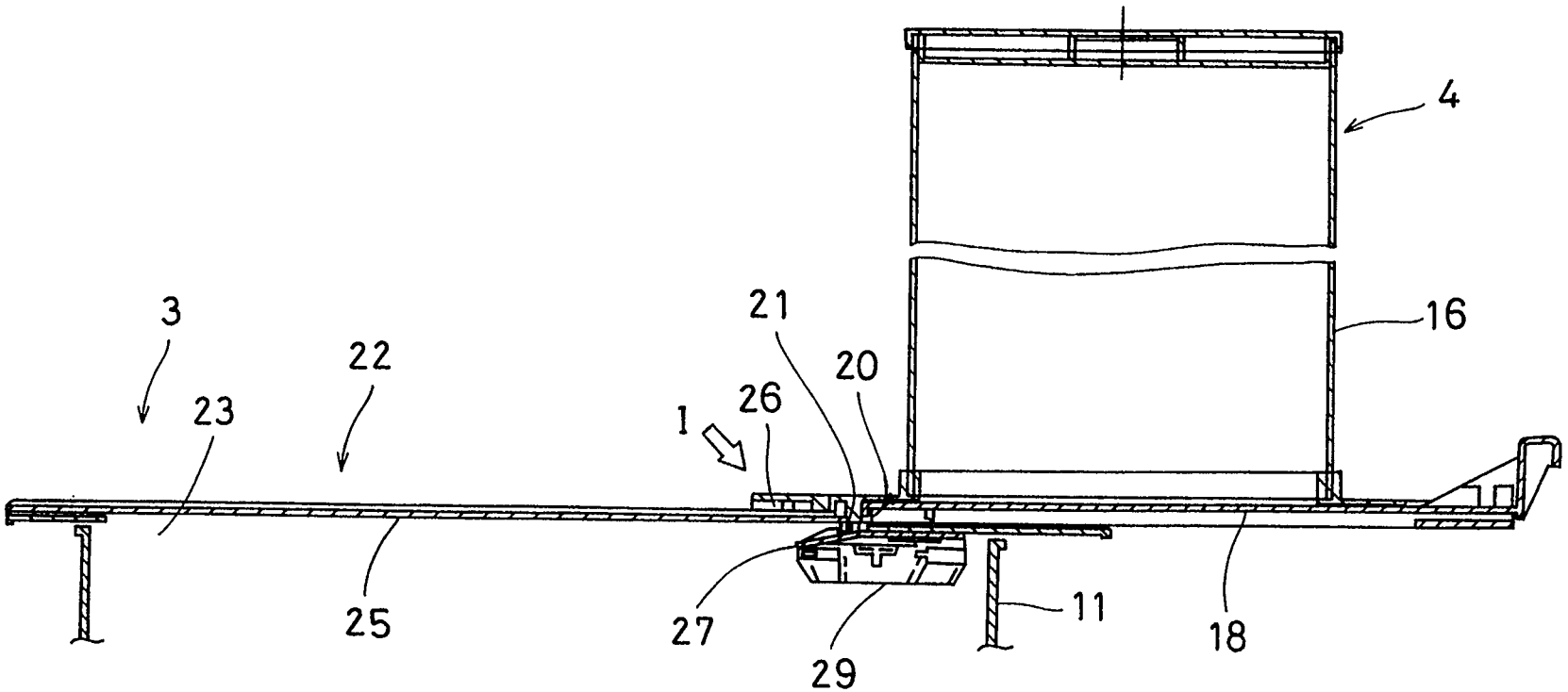
FIG. 11 is an explanatory view showing the operating procedures on mounting the cartridge on and removing it from the hopper.
Figure 12:
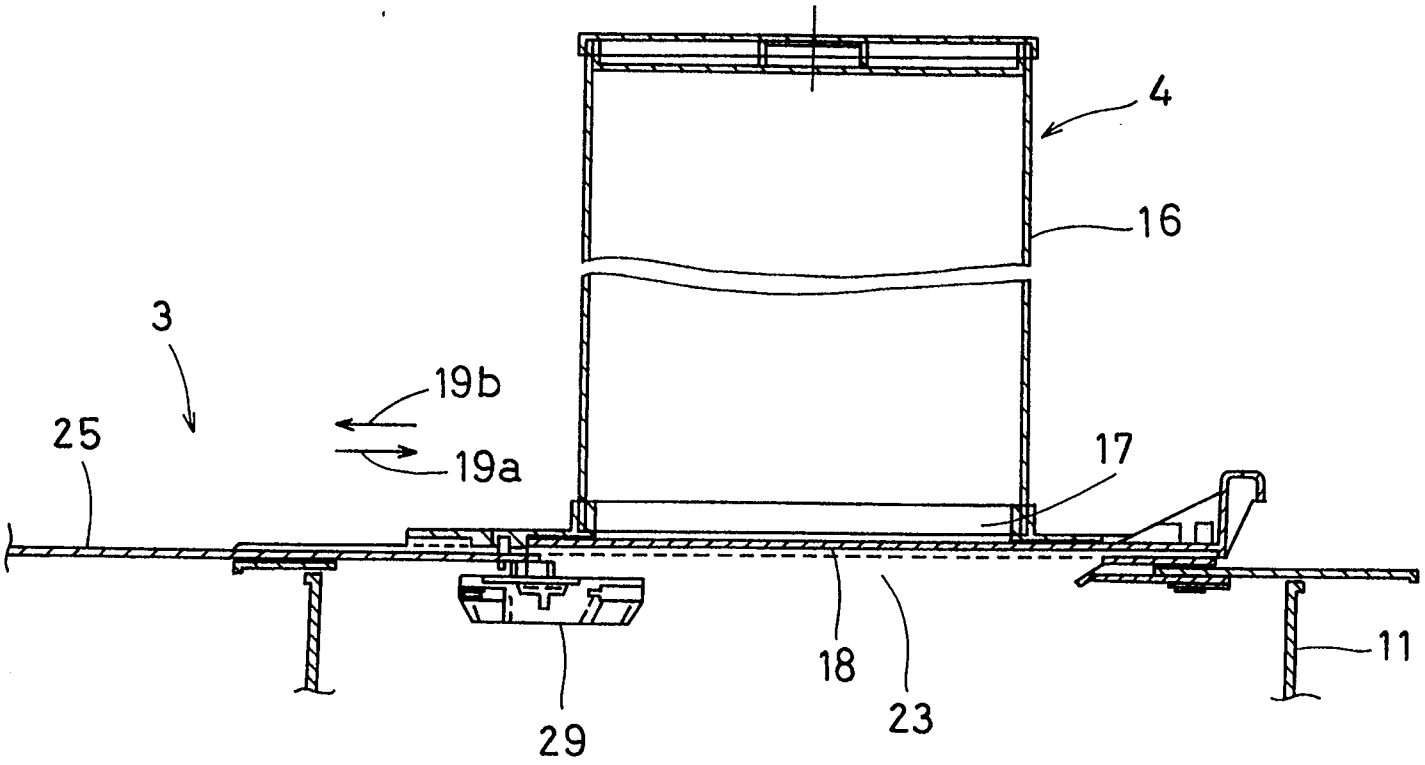
FIG. 12 is an explanatory view showing the operating procedures on mounting the cartridge on and removing it from the hopper.
Figure 17:
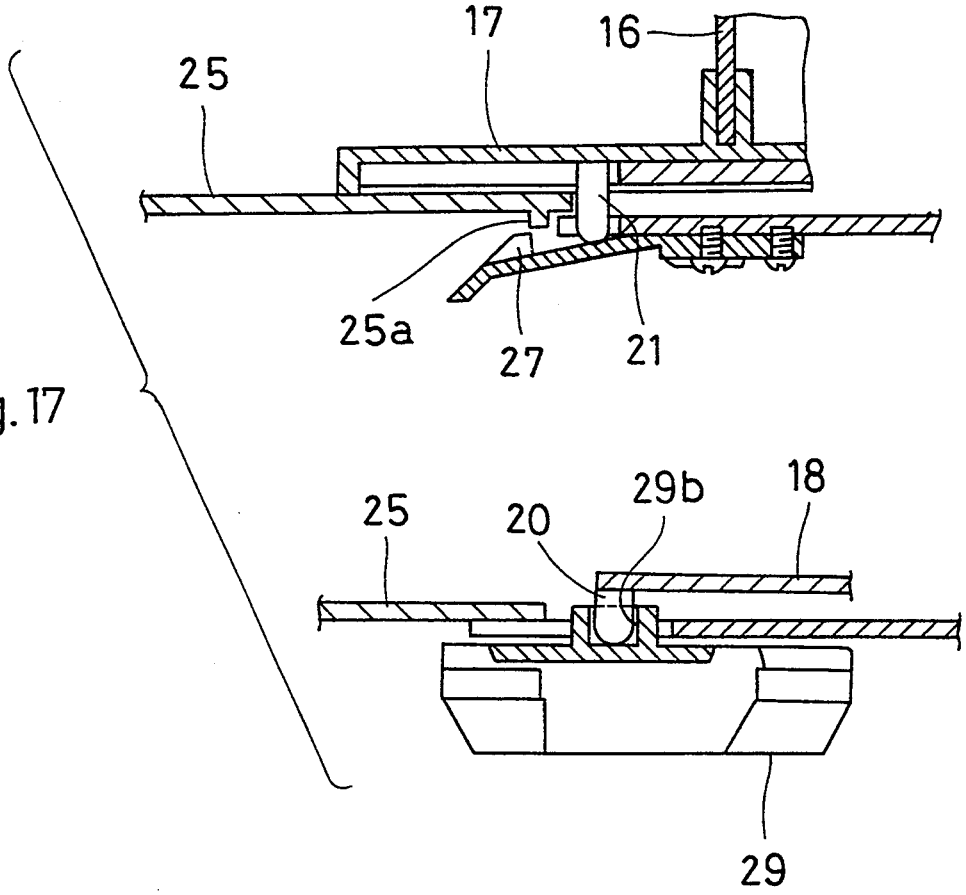
FIG. 17 is an explanatory view showing the disassembled status of the construction shown with an arrow I in FIG. 11.

Firstly, when the the accommodating port 23 of the hopper 3 is closed by the opening/closing cover 25 and the opening/closing cover 25 is engaged with the hook 27, the cartridge 4 is positioned so that the projections 20, 21 can correspond to the engaging hole **29*b* of the leveling member 29 and the hook 27, respectively, (FIG. 10, FIG. 15 and FIG. 16), and an edge portion of the cartridge body 16 of the cartridge 4 is pushed in downwards along one edge side of the projection 26 of the opening/closing cover 25 (FIG. 1, FIG. 11, and FIG. 17**).

Thereby, the opening/closing cover 25 is released from engagement with the hook 27 and enters openable status, and the leveling member 29 enters such a state that it can move together with the cartridge body 16 and the shutter 18.

Under this condition, when the cartridge body 16 is made to move in the direction of an arrow **19*b* (Refer to FIG. 12), the opening/closing cover 25 is opened and at the same time the leveling member 29 is made to move in the direction of an arrow 19***b*, too.

Figure 13:
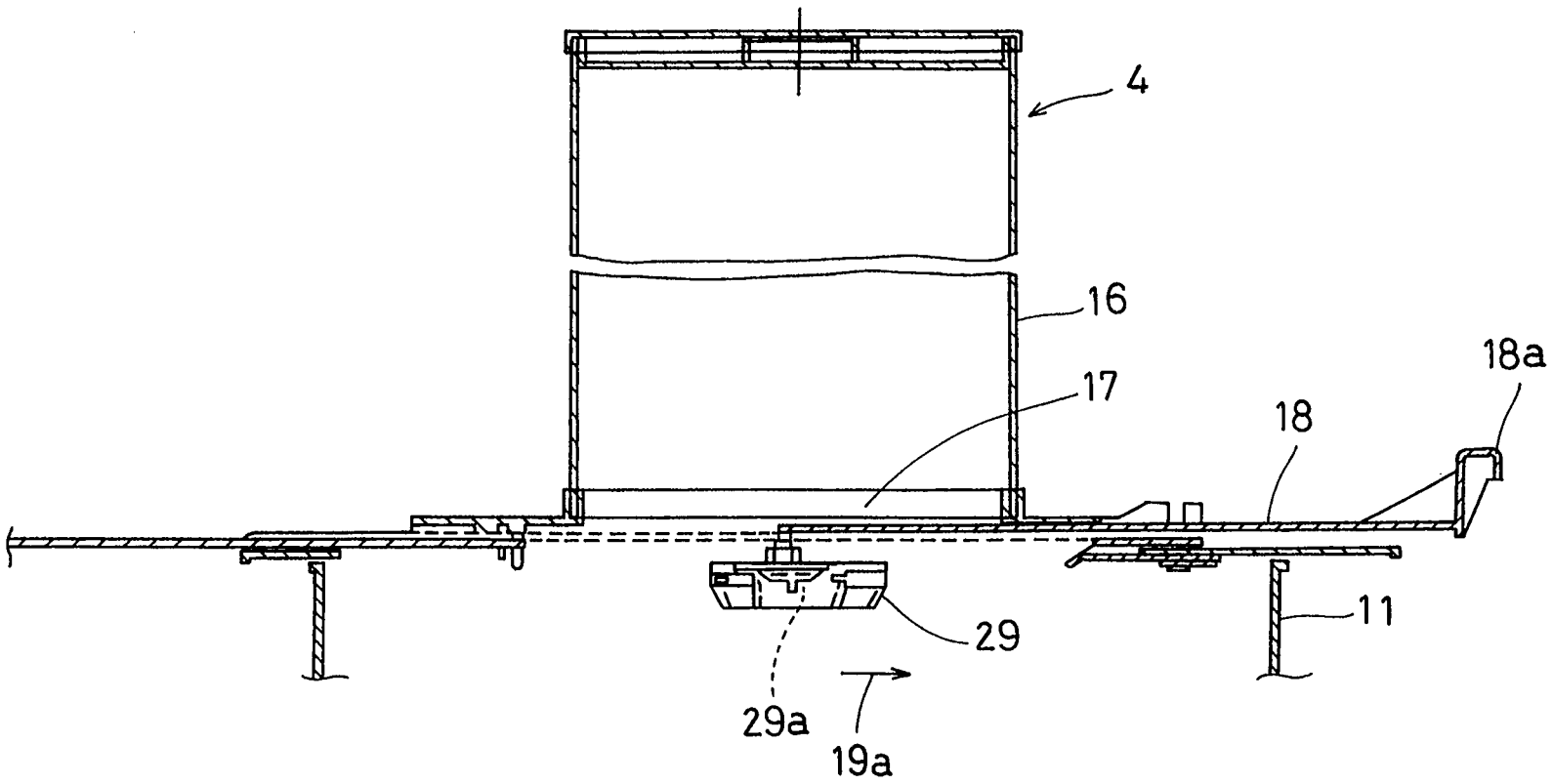
FIG. 13 is an explanatory view showing the operating procedures on mounting the cartridge on and removing it from the hopper.

Subsequently, as shown in FIG. 13, when a grip 18*a* is grasped and the shutter 18 is made to move in the direction of an arrow 19*a*, the feeding port 17 of the cartridge 4 is gradually opened from the left side in the same Figure. In line therewith, toner drops through the opening portion of the feeding port 17 and the opening portion 29*a* of the leveling member 29 toward the hopper housing 11 from the cartridge body 16. A part thereof is leveled by the leveling member 29 which moves in line with the opening movement of the shutter 18.

Figure 14:
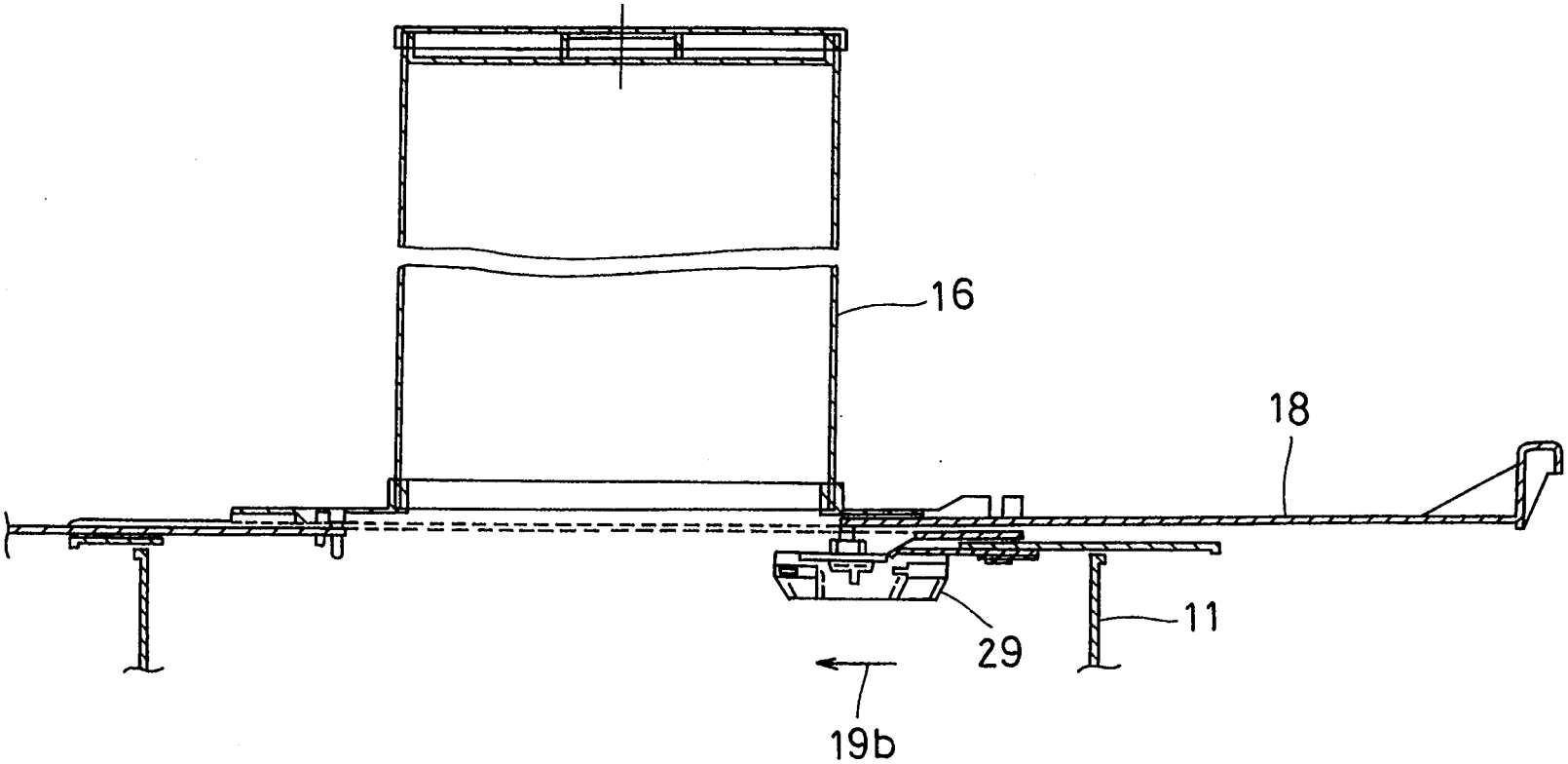
FIG. 14 is an explanatory view showing the operating procedures on mounting the cartridge on and removing it from the hopper.

And as shown in FIG. 14, under such a state that the shutter 18 is completely opened, toner accommodated in the cartridge body 16 is completely dropped into the hopper housing 11 by tapping the outside surface of the cartridge body 16, etc. By shifting the shutter 18 in the direction of an arrow 19*b* from this state, the feeding port 17 of the cartridge body 16 is going to be closed, and at the same time a heap-up of toner in the hopper housing 11 is broken down and leveled by the leveling member 29 which moves together with the shutter 18.

And, under such a condition that the feeding port 17 of the cartridge body 16 is completely closed by the shutter 18 (Refer to FIG. 12), the accommodating port 23 of the hopper 3 is going to be closed by the opening/-closing cover 25 which is made to move by engagement between the cartridge body 16 and the projection 26 as making the cartridge body 16 move in the direction of an arrow 19*a*, and at the same time the cartridge 4 reaches the position where it can be disengaged from the hopper 3 (Refer to FIG. 11). Furthermore, at this time, as the leveling member 29 is made to move in line with movement of the cartridge 4, toner in the hopper housing 11 can be furthermore effectively leveled.

Namely, in a toner feeding device according to the present preferred embodiment, as described above, as the leveling member 29 is necessarily made to operate a plurality of number of times in line with the mounting and removing operation of the cartridge 4 for the hopper 3 and the opening and closing operation of the shutter 18 when feeding toner to the hopper 3, it is possible to effectively break down and level a heap-up of toner built through dropping thereof from the cartridge 4 to the hopper 3. At this time, as the top of heaped up toner is leveled so that it can ride on the side of the moving leveling member 29 and be circulated through the opening 29*a*, it is possible to maintain the fluidity of toner and to secure an effect of blocking prevention of toner inside the hopper 3.

Furthermore, in a device of the present preferred embodiment, since the cartridge 4 can be mounted on the hopper 3 and removed therefrom only when the shutter 18 is in its closed status for the cartridge 4, it is possible to prevent toner from leakage from the cartridge 4 with a simple mechanical improvement.

Furthermore, in the above construction, even though it is erroneously tried that the cartridge body 16 is made to move in the direction of an arrow 19*a* along the rails 24, 24 for the sake of removing the cartridge 4 when the shutter 18 is in its opened status, the feeding port 17 of the cartridge 4 is necessarily closed by the shutter 18 when the cartridge body 16 reaches the engaging and disengaging position releasable from the hopper 3 as the movement of shutter 18 is regulated by the regulating unit 31 by way of the leveling member 29.

As a result, even though the cartridge 4 is tried to be removed by mistake, the feeding port 17 of the cartridge 4 is always in its closed status by the shutter 18.

Furthermore, in the case that the construction of the preferred embodiment is composed without use of a leveling member 29, the positional regulation of the shutter 18 of the cartridge 4 in relation to the accommodating port 23 of the hopper 3 can be accomplished by direct engagement between the projection 20 of the shutter 18 and the regulating unit 31.

Figure 18:
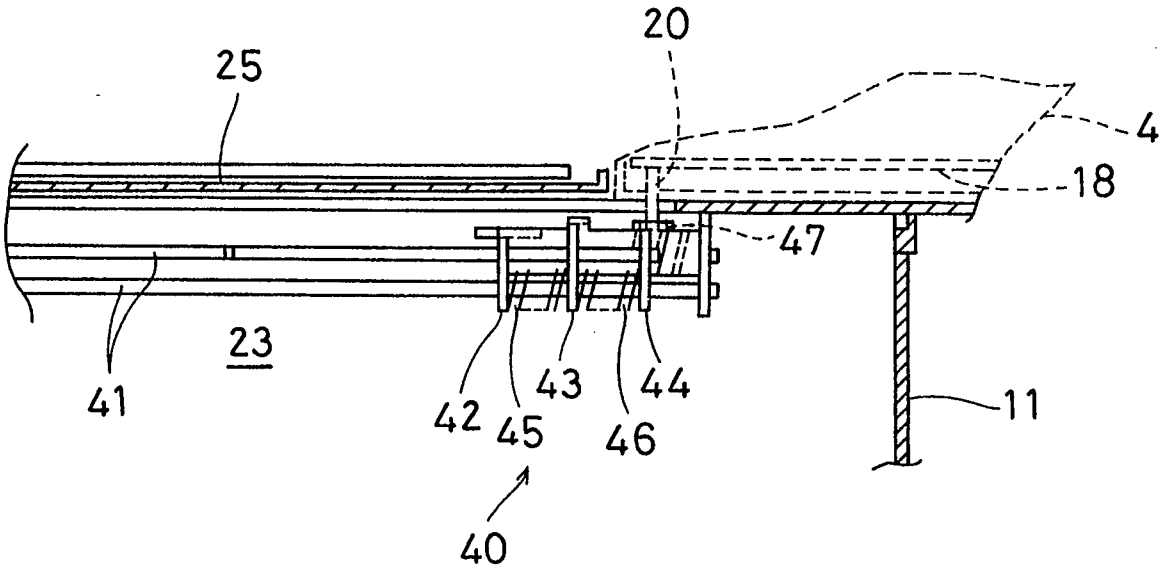
FIG. 18 is an explanatory view showing a leveling member according to a still another preferred embodiment, which is applicable to the hopper.

A leveling member 40 composed by having a plurality of leveling plates as shown for example in FIG. 18 may be used instead of leveling members 29, 30 according to the above preferred embodiments.

For the leveling member 40 according to this preferred embodiment, as shown in the same Figure, a plurality of supporting axes 41 are disposed in the lengthwise direction (the mounting and removing direction of the cartridge 4) of the accommodating port 23 of the hopper housing 11, and for example, three pieces of leveling plates 42, 43, 44 of roughly the same shape are shiftably fitted and inserted on these supporting axes 41 by way of compression springs 45, 46. And by engagement between the projection 20 installed at the shutter 18 of the cartridge 4 and the linkage hole 47 installed at the leveling plate 44, the leveling member 40 moves in line with mounting and removal of the cartridge 4 and opening and closing of the shutter 18. In this case, on the occasion of movement of the leveling member 40, toner can be efficiently leveled by mutual action of the three pieces of leveling plates and elastic movement of compression springs.

What is claimed is:

1. A toner feeding device in which a cartridge accommodating toner is removably installed at an opening provided at the upper part of the hopper, and the toner accommodated in the cartridge is fed to the hopper through a feeding port provided at the lower part of the cartridge and an accommodating port provided at the opening of the hopper and at the same time the toner accommodated in the hopper is leveled by actuating a leveling member provided downwards from the opening thereof, comprising:

opening/closing means which is slidably installed at the lower part of the cartridge for opening and closing the feeding port; and guide means which is installed at the opening of the hopper and slidingly guides the cartridge in parallelism with the opening and closing direction of the opening/closing means from the engaging and disengaging position of the cartridge to the mounted position thereof where the feeding port is confronted to the accommodating port; and being characterized in that the leveling member is shiftably supported in parallelism with the opening and closing direction of the opening/closing means within the hopper and at the same time the opening/closing means is removably engaged with the leveling member at the engaging and disengaging position of the cartridge, and the leveling member is actuated in line with the engaging and disengaging operation of the cartridge for opening and closing operation of the opening/closing means to level the toner accommodated in the hopper.

2. A toner feeding device defined in claim 1, wherein the cartridge is mounted at the hopper only when feeding toner and is disengaged from the hopper after toner in the cartridge is fed to the hopper.

3. A toner feeding device defined in claim 2, wherein the accommodating port of the hopper is closed by an opening/closing cover when the cartridge is not mounted and at the same time the opening/closing cover is locked by a locking mechanism.

4. A toner feeding device defined in claim 3, wherein the locking mechanism consists of an engaged part formed at the opening/closing cover of the hopper and an engaging piece which is installed at the housing body of the hopper and is elastically engageable with the engaged part and disengageable therefrom.

5. A toner feeding device defined in claim 4, wherein the first projection which can be fitted to the engaging piece and engaged therewith on the cartridge, and the opening/closing cover is made to move in the opening direction thereof by releasing the engagement with the engaged part through operation of the engaging piece by the first projection when mounting the cartridge at the hopper.

6. A toner feeding device defined in claim 5, wherein the opening/closing means of the cartridge is provided with the second projection and the leveling member is provided with an engaging hole which is engageable with the second projection.

7. A toner feeding device defined in claim 6, wherein opening movement of the opening/closing cover is permitted by engagement of the first projection with the engaging piece, and at the same time the leveling member can reciprocate in line with mounting and removing movements of the cartridge for the hopper and opening and closing movements of the opening/closing means of the cartridge by engagement of the second projection with the engaging hole.

8. A toner feeding device defined in claim 6, wherein a positioning mechanism for mounting the cartridge at the hopper is provided at the opening/closing cover and the cartridge.

9. A toner feeding device defined in claim 3, wherein the opening/closing cover and the leveling member are slidably supported by different guide mechanisms.

10. A toner feeding device defined in claim 1, wherein the leveling member is provided, roughly at the central part thereof, with an opening through which toner passes.

11. A toner feeding device defined in claim 1, wherein both the sides of the leveling member roughly at right angle direction in relation to the direction of movement thereof are inclined and formed so that one of the sides thereof can come behind the other side thereof when the leveling member moves.

12. A toner feeding device defined in claim 11, wherein a toner feeding roller to feed toner into a developing housing is provided at the lower part of the housing body of the hopper, and the toner feeding roller is positioned downwards of one side below the leveling member.

13. A toner feeding device defined in claim 1, wherein the leveling member is provided with a side which makes push-flow direction of toner reversed at the forward direction and return direction.

14. A toner feeding device defined in claim 1, wherein the guide means permits the cartridge to be engaged and disengaged only the opening/closing means is in its closed status for the cartridge and is composed so that it can slidingly guide the cartridge from the engaging and disengaging position of the cartridge to the mounted position thereof when the cartridge cannot be disengaged from the hopper, and regulating means which prevents the movement of the opening/closing means exceeding the area corresponding to the accommodating port of the hopper with the cartridge engaged with the guide means is provided at the opening of the hopper.

15. A toner feeding device defined in claim 1, wherein the leveling member is composed of a plurality of leveling plates.

16. A toner feeding device defined in claim 15, wherein the leveling plates are provided in parallel by way of spring members.

17. A toner cartridge which is mounted on a hopper only when feeding toner and removed from said hopper after toner feeding is finished, said hopper consisting of a leveling member for leveling toner, an opening/closing cover which closes a toner accommodating port and a locking mechanism for locking said hopper, and wherein a body of said lower cartridge is provided with an opening/closing means for opening and closing the toner accommodating port a first projection for releasing the locking mechanism when the body is mounted at the hopper and a second projection for enabling leveling action upon engagement with the leveling member.

18. A toner cartridge defined in claim 17, wherein the body is engaged for positioning with a positioning engaging part, which is installed at the opening/closing cover when mounting the toner cartridge at the hopper.

19. A toner feeding device in which a cartridge accommodating toner is removably mounted at an opening installed at an upper part of a hopper, and the toner accommodated in the cartridge is fed to the hopper through a feeding port installed at a lower part of the cartridge and an accommodating port installed at the opening of the hopper, comprising:

opening/closing means slidably installed at the lower part of the cartridge for opening and closing the feeding port;

guide means which is installed at the opening of the hopper for permitting the cartridge to be engaged and disengaged therefrom only when the opening/closing means is in its closed status for the cartridge, and slidably guides the cartridge from the engaging and disengaging position of the cartridge to the mounted position when the feeding port confronts the accommodating port, in parallel with the opening and closing direction of the opening/closing means, so that the cartridge can not be disengaged from the hopper; and regulating means which is installed at the opening of the hopper and regulates the movement of the opening/closing means from exceeding the area corresponding to the accommodating port of the hopper when the cartridge is engaged with the guide means; and wherein the cartridge is mounted at the hopper only when feeding toner and is disengaged from the hopper after the toner from the cartridge is fed to the hopper; and the accommodating port of the hopper is closed by the opening/closing means when the cartridge is not mounted and at the same time the opening/closing means is locked by a locking mechanism.

20. A toner feeding device defined in claim 19, wherein the locking mechanism comprises an engaged part formed at the opening/closing cover of the hopper and an engaging piece which is installed at the housing body of the hopper and can be elastically engaged with the engaged part and disengaged therefrom.

21. A toner feeding device defined in claim 20, wherein the first projection engageable with the engaging piece is provided at the cartridge, and the opening/-closing cover is made to move in the opening direction thereof by releasing the engagement with the engaged part through operation of the engaging piece by the first projection when the cartridge is mounted at the hopper.

* * * * *